US007797782B2

(12) United States Patent
Davis et al.

(10) Patent No.: US 7,797,782 B2
(45) Date of Patent: Sep. 21, 2010

(54) HANDLE HAVING A RIBBED GEL GRIP

(75) Inventors: Christopher J. Davis, Atlanta, GA (US); Denise Silbert, Atlanta, GA (US); Stan Chudzik, Alpharetta, GA (US); Michael Defenbaugh, Marietta, GA (US); Aaron Hawkins, Charlotte, NC (US)

(73) Assignee: Goody Products, Inc., Atlanta, GA (US)

( * ) Notice: Subject to any disclaimer, the term of this patent is extended or adjusted under 35 U.S.C. 154(b) by 1129 days.

(21) Appl. No.: 11/425,070

(22) Filed: Jun. 19, 2006

(65) Prior Publication Data

US 2007/0017540 A1 Jan. 25, 2007

Related U.S. Application Data

(60) Provisional application No. 60/692,465, filed on Jun. 21, 2005.

(51) Int. Cl.
*A46B 5/02* (2006.01)
*B25G 1/10* (2006.01)

(52) U.S. Cl. ..... 15/143.1; 16/430

(58) Field of Classification Search ..... 15/143.1; 16/430

See application file for complete search history.

(56) References Cited

U.S. PATENT DOCUMENTS

| | | | | |
|---|---|---|---|---|
| 141,287 | A | 7/1873 | Orndorff | |
| 255,961 | A | 4/1882 | Faber | |
| 376,540 | A * | 1/1888 | McQuide | 15/143.1 |
| 412,479 | A | 10/1889 | Davis | |
| 544,990 | A | 8/1895 | Miller | |
| 614,630 | A | 11/1898 | Stewart | |
| 624,853 | A | 5/1899 | Oberbeck | |
| 770,363 | A | 9/1904 | Goldsmith | |
| 782,388 | A | 2/1905 | Goldsmith | |
| 839,537 | A | 12/1906 | Beaumel | |
| 1,868,441 | A | 7/1932 | Colfelt | |

(Continued)

FOREIGN PATENT DOCUMENTS

| | | |
|---|---|---|
| DE | 1 511 325 | 7/1969 |

(Continued)

OTHER PUBLICATIONS

SkyMall Catalog, Holiday Gift Guide 1999 (2 pages).

*Primary Examiner*—Randall Chin
(74) *Attorney, Agent, or Firm*—Gardner Groff Greenwald & Villanueva, P.C.

(57) ABSTRACT

A grip for a graspable item having a body and a handle connected to and extending outwardly away from the body. The grip includes a hollow core configured to slide onto the handle, and a hollow sleeve having a plurality of outwardly extending ribs disposed on the external surface of the sleeve. The sleeve is configured to slide onto the exterior of the core such that the core and the sleeve define a cavity therebetween. The grip further includes a quantity of a gel disposed within the cavity. The ends of the sleeve are sealed against the corresponding ends of the core to retain the gel within the cavity, and the gel allows the sleeve to deform to conform to the shape of a user's hand when the handle of the graspable item is grasped by the user.

21 Claims, 12 Drawing Sheets

U.S. PATENT DOCUMENTS

| | | | | | |
|---|---|---|---|---|---|
| 1,963,360 | A | | 6/1934 | Gibbin et al. | |
| 2,205,769 | A | | 6/1940 | Sweetland | |
| 2,236,194 | A | | 3/1941 | Lorber | |
| 2,362,948 | A | | 11/1944 | Teague et al. | |
| 2,845,047 | A | | 7/1958 | McKendree | |
| 3,269,399 | A | | 8/1966 | Smith | |
| 3,548,420 | A | | 12/1970 | Spence | |
| 3,663,973 | A | | 5/1972 | Spence | |
| 3,782,390 | A | | 1/1974 | Johnson | |
| 3,863,271 | A | | 2/1975 | Moroney | |
| 4,035,089 | A | | 7/1977 | Schwartz et al. | |
| 4,044,625 | A | | 8/1977 | D'Haem et al. | |
| 4,050,727 | A | | 9/1977 | Bonnes | |
| 4,167,192 | A | | 9/1979 | Arnold | |
| 4,167,347 | A | | 9/1979 | Hoyle | |
| 4,168,754 | A | | 9/1979 | Nyholm | |
| 4,338,270 | A | | 7/1982 | Uffindell | |
| 4,364,150 | A | | 12/1982 | Remington | |
| 4,385,024 | A | | 5/1983 | Tansill | |
| 4,386,620 | A | | 6/1983 | Handler | |
| 4,601,598 | A | | 7/1986 | Schwartz et al. | |
| 4,617,347 | A | | 10/1986 | D'Sidocky | |
| 4,617,697 | A | | 10/1986 | David | |
| 4,621,387 | A | * | 11/1986 | Noser | 15/167.1 |
| 4,719,063 | A | | 1/1988 | White | |
| 4,737,226 | A | | 4/1988 | Inoue | |
| 4,911,569 | A | | 3/1990 | Hashimoto et al. | |
| 4,932,800 | A | | 6/1990 | Lin et al. | |
| 4,934,024 | A | | 6/1990 | Sexton | |
| 4,964,192 | A | | 10/1990 | Marui | |
| 5,000,599 | A | | 3/1991 | McCall et al. | |
| 5,050,289 | A | | 9/1991 | Uffindell | |
| 5,159,717 | A | | 11/1992 | Drew et al. | |
| 5,190,504 | A | | 3/1993 | Scatterday | |
| 5,216,091 | A | | 6/1993 | Stern et al. | |
| D338,915 | S | | 8/1993 | Willat | |
| 5,305,490 | A | * | 4/1994 | Lundgren | 15/167.1 |
| 5,327,611 | A | | 7/1994 | Balster et al. | |
| 5,336,352 | A | | 8/1994 | Tokura | |
| 5,336,708 | A | | 8/1994 | Chen | |
| 5,355,552 | A | | 10/1994 | Huang | |
| D362,274 | S | | 9/1995 | Willat | |
| D389,651 | S | | 1/1998 | Chan et al. | |
| 5,716,303 | A | | 2/1998 | Scatterday | |
| 5,781,958 | A | | 7/1998 | Meessmann et al. | |
| 5,887,600 | A | | 3/1999 | Wilk | |
| 5,956,796 | A | | 9/1999 | Lodato | |
| 5,970,581 | A | | 10/1999 | Chadwick et al. | |
| 5,987,656 | A | | 11/1999 | Kakutani | |
| 6,049,936 | A | | 4/2000 | Holley | |
| D428,553 | S | | 7/2000 | Willat et al. | |
| 6,146,038 | A | | 11/2000 | Mittersinker et al. | |
| 6,158,910 | A | | 12/2000 | Jolly et al. | |
| D439,056 | S | | 3/2001 | Woodnorth et al. | |
| D439,277 | S | | 3/2001 | Rosenbaum | |
| D440,106 | S | | 4/2001 | Weisz | |
| D440,769 | S | | 4/2001 | Woodnorth et al. | |
| D440,771 | S | | 4/2001 | Woodnorth et al. | |
| D448,805 | S | | 10/2001 | Willat et al. | |
| D451,549 | S | | 12/2001 | Willat et al. | |
| 6,438,787 | B1 | * | 8/2002 | Young | 15/210.1 |
| 6,447,190 | B1 | | 9/2002 | Kwitek | |
| D474,809 | S | | 5/2003 | Willat et al. | |
| D482,203 | S | | 11/2003 | Goulet | |
| 6,647,582 | B1 | | 11/2003 | Rechelbacher | |
| 6,648,535 | B2 | | 11/2003 | Ferrara, Jr. | |
| 6,725,505 | B2 | | 4/2004 | Willat | |
| 6,793,426 | B2 | | 9/2004 | Willat | |
| 6,835,015 | B2 | | 12/2004 | Pearce | |
| 2003/0110585 | A1 | | 6/2003 | Rechelbacher | |
| 2003/0123917 | A1 | | 7/2003 | Willat et al. | |
| 2004/0217555 | A1 | | 11/2004 | Willat et al. | |

FOREIGN PATENT DOCUMENTS

| | | | |
|---|---|---|---|
| DE | 2 157 175 | | 5/1973 |
| DE | 2 162 132 | | 6/1973 |
| DE | 34 06 522 | | 9/1985 |
| DE | 297 21 565 | | 3/1998 |
| DE | 100 59 065 | | 6/2002 |
| EP | 0 383 685 | | 8/1990 |
| FR | 1323750 | | 3/1963 |
| GB | 1 267 100 | | 6/1972 |
| WO | WO 03/015588 | * | 2/2003 |

* cited by examiner

HANDLE HAVING A RIBBED GEL GRIP

REFERENCE TO RELATED APPLICATION

This application claims priority from Provisional Application Ser. No. 60/692,465, filed on Jun. 21, 2005, which is expressly incorporated by reference herein.

FIELD OF THE DISCLOSURE

The present disclosure is generally directed to devices having gel grip handles and, more particularly, to personal care products such as hair brushes and the like, and other graspable implements, having ribbed gel grip handles.

BACKGROUND OF THE DISCLOSURE

Hair brushes and hair brush handles are generally known in the art. These hair brushes, however, are inflexible and do not contour to an individual's hand while brushing or styling. Such inflexibility can cause strain and tension on the user's hands or wrists. Additionally, with prolonged usage of such hair brushes or handles, Carpal tunnel syndrome and hand/wrist strain may become apparent. Similarly, other hair care devices, accessories and personal care items are typically provided with rigid handles or body structures.

Efforts have been made to combat the inflexibility of hair brushes, with the use of gel or gel-filled handles, but a total solution providing comfort flexibility and an improved tactile feel has yet to be provided.

SUMMARY OF THE INVENTION

In one aspect, the invention is directed to a hair brush having a body having a plurality of outwardly extending bristles, a post connected to and extending outwardly away from the body, and a grip disposed on the post. The grip includes a hollow core configured to slide onto the post, and a hollow sleeve having a plurality of outwardly extending ribs disposed on the external surface of the sleeve, wherein the sleeve is configured to slide onto the exterior of the core such that the core and the sleeve define a cavity therebetween. The grip further includes a quantity of a gel disposed within the cavity, wherein the ends of the sleeve are sealed against the corresponding ends of the core to retain the gel within the cavity, and wherein the gel allows the sleeve to deform to conform to the shape of a user's hand when the grip is grasped by the user.

In another aspect, the invention is directed to a grip for a graspable item having a body and a handle connected to and extending outwardly away from the body. The grip includes a hollow core configured to slide onto the handle, and a hollow sleeve having a plurality of outwardly extending ribs disposed on the external surface of the sleeve. The sleeve is configured to slide onto the exterior of the core such that the core and the sleeve define a cavity therebetween. The grip further includes a quantity of a gel disposed within the cavity. The ends of the sleeve are sealed against the corresponding ends of the core to retain the gel within the cavity, and the gel allows the sleeve to deform to conform to the shape of a user's hand when the handle of the graspable item is grasped by the user.

In a further aspect, the invention is directed to a personal care item having a body, a post connected to and extending outwardly away from the body, and a grip disposed on the post. The grip includes a hollow core configured to slide onto the post, and a hollow sleeve having a plurality of outwardly extending ribs disposed on the external surface of the sleeve, wherein the sleeve is configured to slide onto the exterior of the core such that the core and the sleeve define a cavity therebetween. The grip further includes a quantity of a gel disposed within the cavity. The ends of the sleeve are sealed against the corresponding ends of the core to retain the gel within the cavity, and the gel allows the sleeve to deform to conform to the shape of a user's hand when the grip of the personal care item is grasped by the user.

Additional aspects of the invention are defined by the claims of this patent.

BRIEF DESCRIPTION OF THE DRAWINGS

Objects, features, and advantages of the present device will become apparent upon reading the following description in conjunction with the drawing figures, in which.

Figure 1:
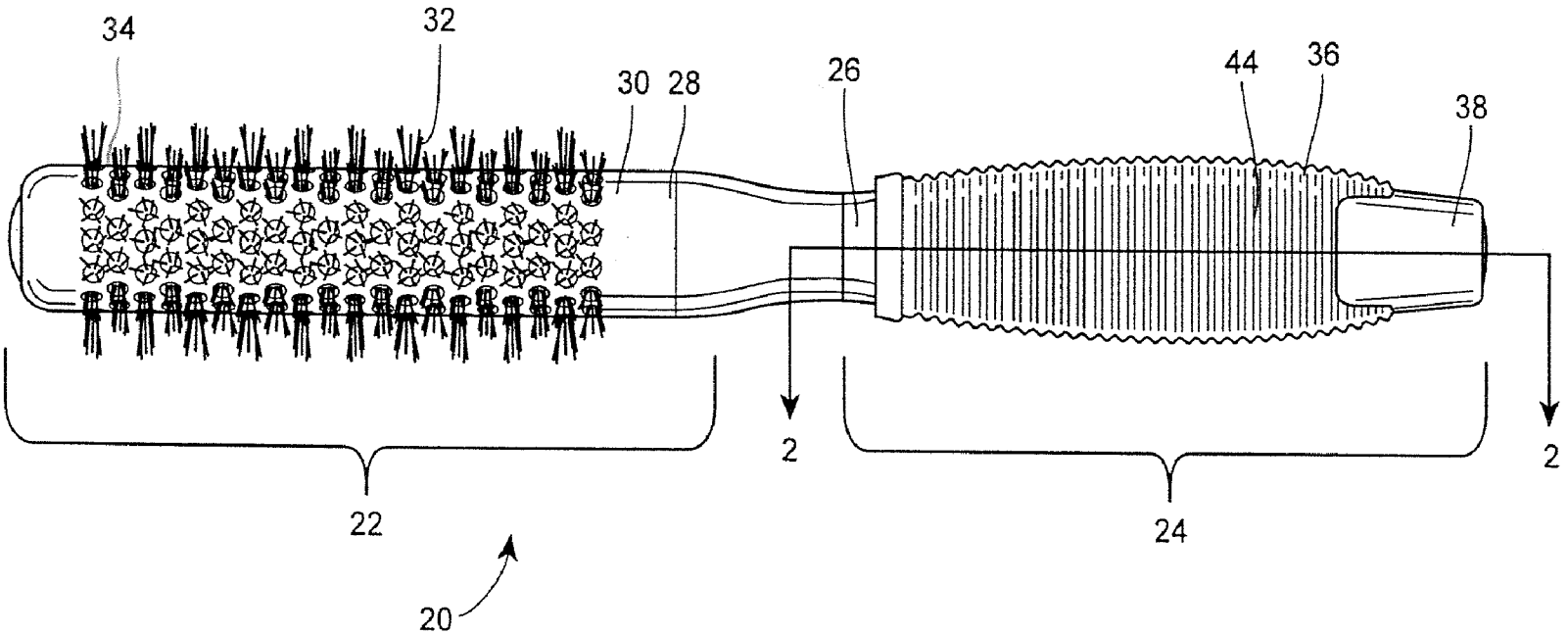
FIG. 1 is a side view of an embodiment of a hair brush having a ribbed gel-filled grip disposed on the handle.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION OF THE DISCLOSURE

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 4:
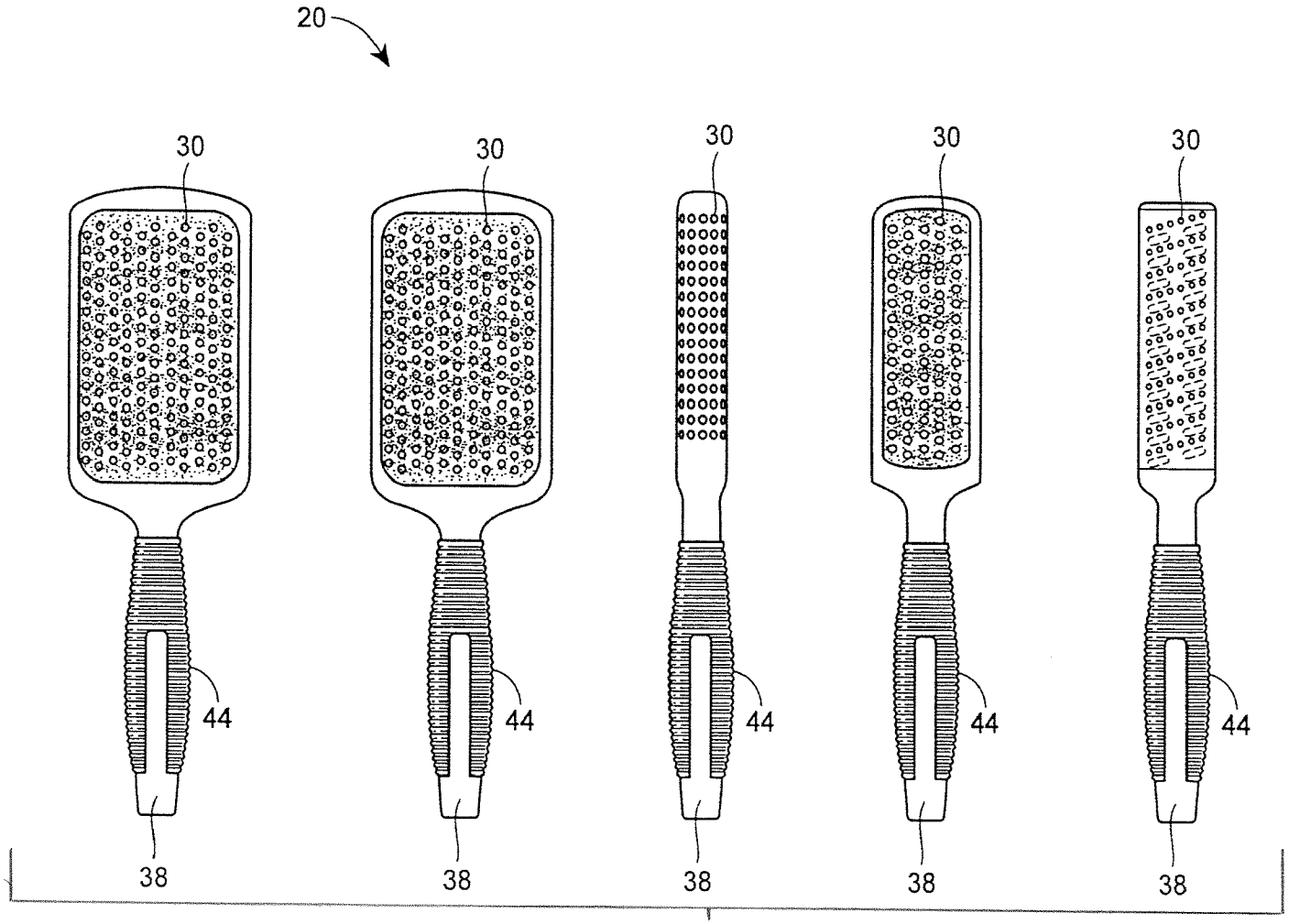
FIG. 4 is a side view of a plurality of alternative embodiments of brushes having ribbed gel-filled grips.
Figure 5:
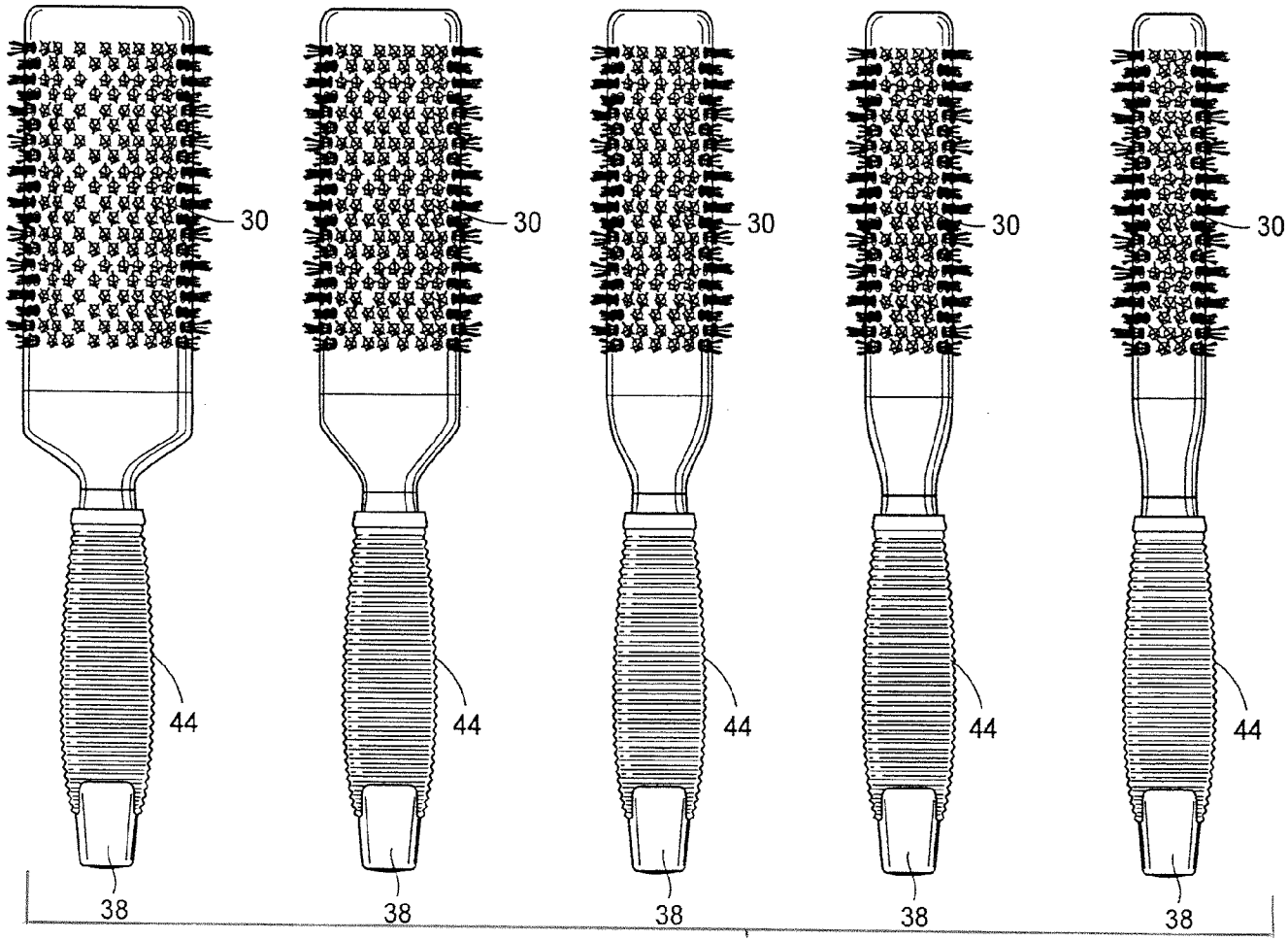
FIG. 5 is a side view of a plurality of further alternative embodiments of brushes having ribbed gel-filled grips.

Referring now to the drawings and with specific reference to FIG. 1, a hair brush 20 having a body 22 and a handle 24 is disclosed. As shown therein, a first end 26 of the handle 24 extends from a second end 28 of the body 22. The body 22 includes a head 30 of the brush 20 having bristles 32 at a first end 34 of the body 22. As illustrated in FIGS. 4 and 5, the head 30 of the brush 20 may vary greatly including in size, shape and material. For example, the head 30 may be round, square, rectangular, oval or cylindrical in shape. Similarly, the bristles 32 may vary in size, length, flexibility, and material.

Figure 3:
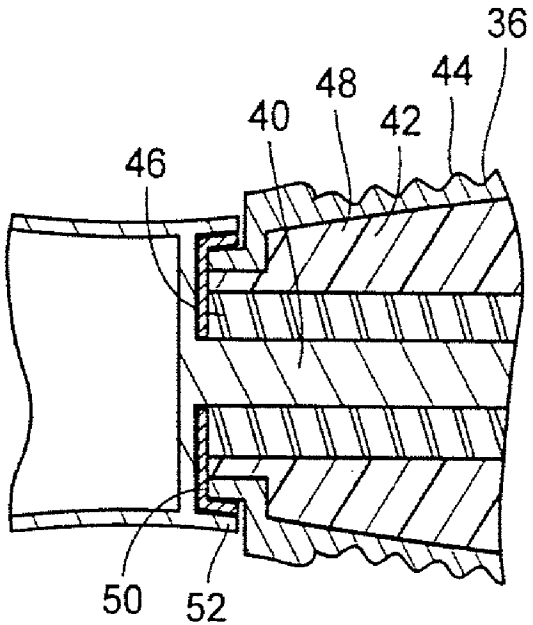
FIG. 3 is an enlarged partial cross-sectional view taken along line 2-2 of FIG. 1 of the hair brush handle having the ribbed gel-filled grip disposed thereon.
Figure 2:
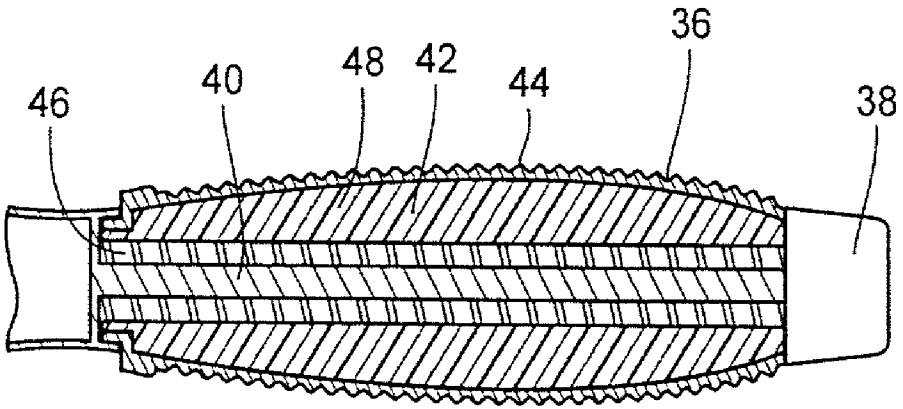
FIG. 2 is a cross-sectional view taken along line 2-2 of FIG. 1 of the hair brush handle having the ribbed gel-filled grip disposed thereon.

The handle 24, as illustrated in FIG. 1, includes a sleeve 36 and a cap 38 disposed on the exterior thereof. As illustrated in further detail in FIGS. 2 and 3, the handle 24 includes a narrow post 40 extending away from the head 30 of the hair brush 20. The ribbed sleeve 36 is disposed over the post 40 and is filled with a silicone gel 42. The sleeve 36 extends along a majority of the handle 24 and provides flexibility of the hair brush 20 along with the ability to contour to a user's hand when gripped such that stresses and strains associated with the use of hair brush 20 is reduced. Additionally, to further improve the grip and feel of the handle 24, the sleeve 36 includes undulations or ridges 44 that provide the user with increased tactile sense and help with gripping. More specifically, as illustrated in FIGS. 2 and 3, the sleeve 36 includes an outer surface having the ridges 44 and an inner surface that, in combination with a hollow core 46, define a cavity 48 for receiving the gel 42. The core 46 is configured to slide over the post 40 when the hair brush 20 is assembled.

Figure 6:
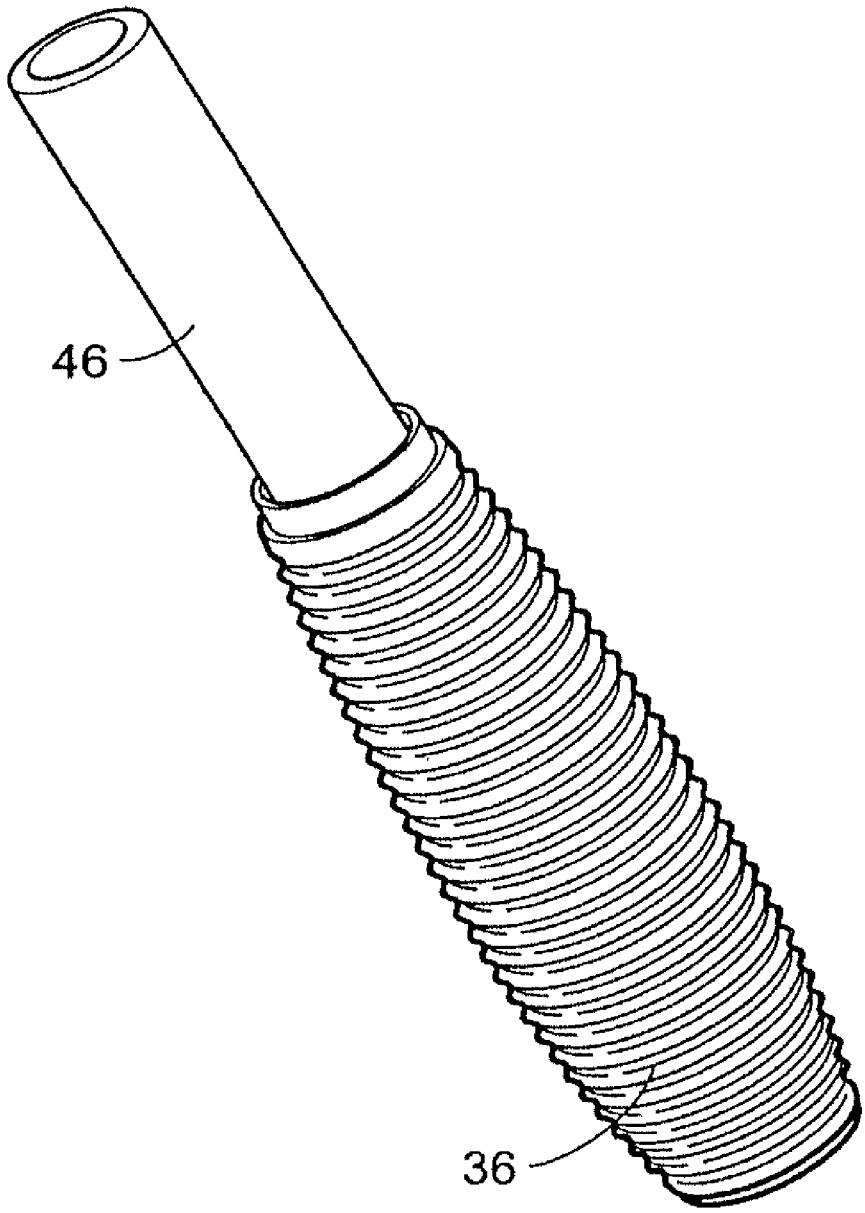
FIG. 6 is a perspective view of the ribbed gel-filled grip of FIG. 1 with the core partially inserted into the sleeve.
Figure 7:
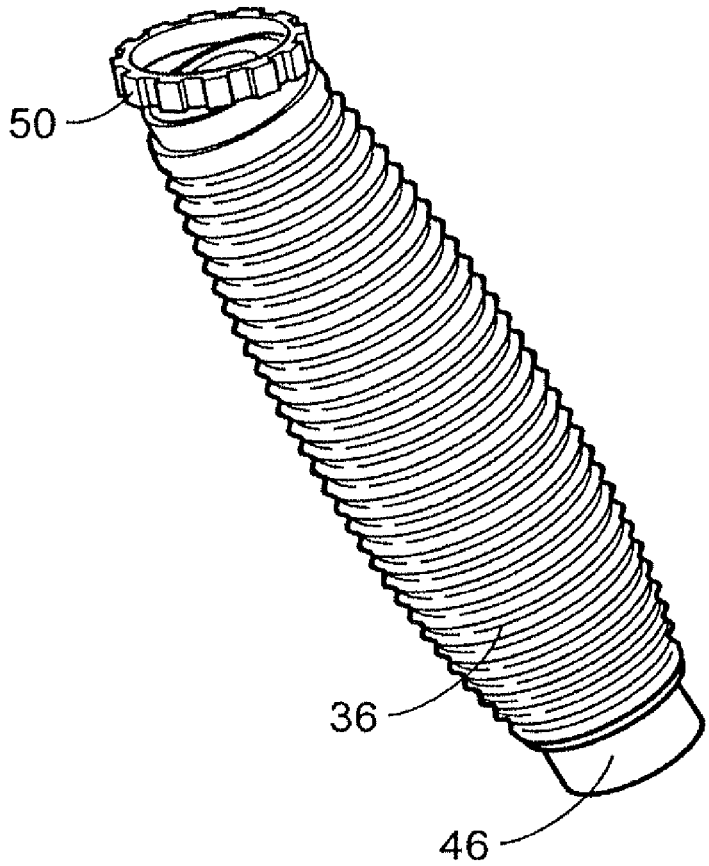
FIG. 7 is a perspective view of the ribbed gel-filled grip of FIG. 1 with the core inserted into the sleeve and the neck ring partially attached to an end thereof.

A process for assembling the ribbed gel grip is illustrated in FIGS. 6 and 7. Referring to FIG. 6, the core 46 is further configured such that the sleeve 36 may be slid onto or otherwise engaged with the exterior of the core 46. Once the sleeve 36 is disposed on the core 46, as seen in FIG. 7, a neck ring 50 may be placed over one end of the sleeve 36 thereby compressing the end of the sleeve 36 between the ring 50 and the core 46 to substantially seal the end of the grip to prevent leakage of the gel 42 disposed in the cavity 48. The neck ring 50 may fit snuggly on the end of the grip to seal the sleeve 36 to the core 46, or may be affixed with an additional adhesive or crimping, or otherwise secured to the end of the grip to ensure a tight, secure seal. The illustrated embodiment is one manner in which the sleeve 36 may be attached to the core 46, but the mechanism for attachment of the components may vary greatly and may include additional structure. For example, the end of the sleeve 36 may be dimensioned to tightly receive the core 46 and engage the outer surface of the core 46 to seal the end of the grip. Still further, the end of the grip may be sealed with an adhesive, or with any other appropriate process for forming a seal between the sleeve 36 and the core 46, such as heat sealing, sonic welding, embossment, mechanical locking geometry, such as snaps or grooves that create a friction lock between the sleeve 36 and the core 46, and the like.

In the illustrated example, as a result of the placement of and engagement by the neck ring 50, the gel 42 is prevented from exiting the cavity 48. After the seal is formed at the end of the grip, the gel 42 may be injected into the cavity 48 at the opposite end of the grip between the sleeve 36 and core 46. Once the gel 42 is injected into the grip, the manner in which the grip is attached to the body 22 may vary greatly. In the illustrated embodiment, the post 40 of the handle 24 may be inserted into the hollow cylinder of the core 46 with the neck ring 50 being received into a neck 52 on the end of the handle 24 proximate the head 30 of the brush 20. Once the grip assembly is disposed on the post 40, the cap 38 may be attached to the end of the grip and/or the post 40, thereby retaining the core 46 and the sleeve 36 on the handle 24. The cap 38 may engage the post 40 by snap fit, screw engagement or other connection mechanism. At the same time, the cap 38 may be configured to engage the proximate end of the grip to seal the cavity 48 by forcing the end of the sleeve 36 against the end of the core 46 to substantially seal the end and prevent leakage of the gel 42. Alternatively, the end of the grip may be sealed by any other mechanism, such as those discussed above and possibly including an additional neck ring 50 disposed on and engaging the end of the grip.

The gel 42 may be a silicon gel as stated earlier, or may be replaced by or include other types of viscous materials that may allow the sleeve 36 to conform to the contours of a user's hand when the handle 24 of the brush 20 is gripped. Similarly, the gel 42 may be varied in volume, viscosity, and/or density to achieve different feels when a user grips the handle 24. The sleeve 36 may also be constructed from a silicone material, or may be constructed from other materials such as thermoplastic elastomer, thermal plastic rubber and polyvinyl alcohol (PVA), for example.

The ridges 44 may be formed in the sleeve 36 during various types of molding processes. In one such process, the outer surface of the sleeve 36 includes the ridges 44, whereas an inner surface of the outer wall is flat as seen in FIG. 3. Alternatively, the inner surface of the sleeve 36 may be molded to include ridges corresponding to the ridges 44 on the outer surface. The ridges 44 may be oriented perpendicular to the longitudinal axis of the handle 24, as illustrated in FIGS. 1 and 2, or may be oriented parallel in any other desired orientation with regard to the longitudinal axis. The ridges or undulation 44 may be formed/molded in other shapes, such as bumps, rings, swirls, nubbins, etc. In operation, the gel filled handle 24 having the ridges 44 provides the user with a more comfortable grip on the brush 20. In addition, the ridges 44 provide increased tactile feel of the brush 20, and provide additional gripping assistance.

Figure 8:
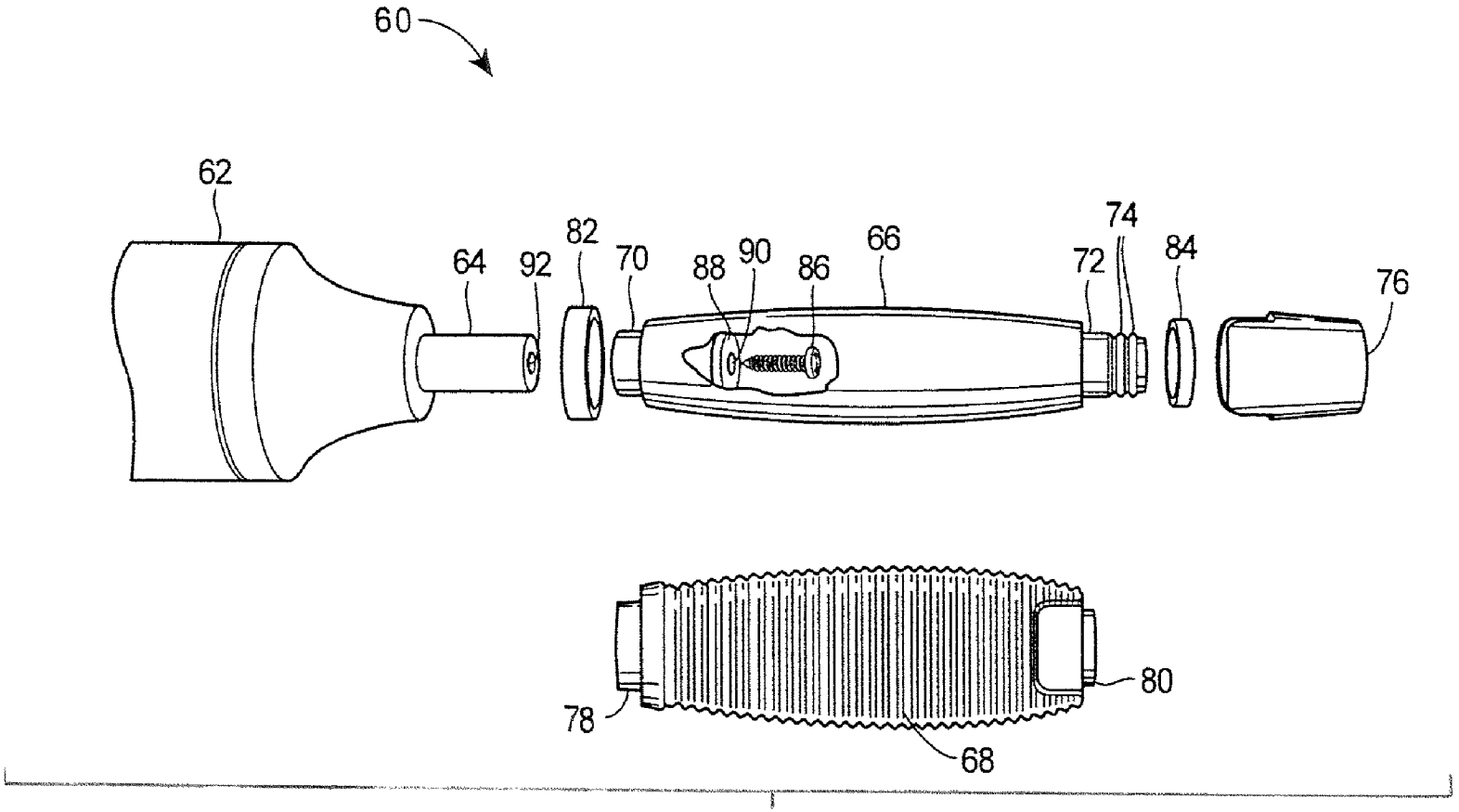
FIG. 8 is a side exploded view of an additional alternative embodiment of a hair brush having a ribbed gel-filled grip disposed on the handle.

FIG. 8 illustrates an exploded view of an alternate configuration of a hair brush 60 wherein the core and sleeve substantially form the handle of the hair brush 60. Similar to the hair brush 20, the hair brush 60 includes a head 62 having an outwardly extending post 64 to which the core 66 and sleeve 68 are connected to form the handle of the hair brush 60. In this embodiment, the post 64 does not extend the entire length of the handle of the hair brush 60, but instead extends part way from the head 62 and is engaged within the interior of the core 66 to secure the core 66 to the post 64 in a manner described more fully below. The hollow core 66 is configured in a similar manner as the core 46, and includes a first neck 70 having a reduced outer diameter and dimensioned to receive the post 64 during assembly. The core 66 further includes second neck 72 disposed on the opposite end of the core 66 from the first neck 70 and having a reduced outer diameter with one or more annular ribs 74 around the outer surface thereof to engage and retain an end cap 76 of the hair brush 60 in a manner described more fully below.

The hollow sleeve 68 is similar to the sleeve 36 and combines with the core 66 to define a cavity for receiving the gel. The sleeve 68 includes first and second ends 78, 80 corresponding to the first and second necks 70, 72 of the core 66, respectively, having reduced outer diameters and inner diameters dimensioned to correspond to the outer diameters of the corresponding necks 70, 72. In order to seal the cavity formed by the core 66 and sleeve 68, the hair brush 60 further includes neck rings 82, 84 similar to those described above and configured to compress the ends 78, 80 into engagement with the necks 70, 72 to form substantially air and water tight seals preventing the gel from seeping out of the cavity. Of course, other sealing mechanisms such as those described above may be implemented an addition or as alternatives to the compression provided by the neck rings 82, 84 to seal the cavity.

The process for assembling the handle of the hair brush 60 may be similar to that described above for the hair brush 20. The sleeve 68 may be slid onto or otherwise engaged with the exterior of the core 66, with the first end 78 disposed over the first neck 70, and the second end 80 disposed over the second neck 72. Once the sleeve 68 is disposed on the core 66, the neck ring 82 may be placed over the first end of the sleeve 68 thereby compressing the end of the sleeve 68 between the neck ring 82 and the first neck 70 of the core 66 to substantially seal the end of the grip to prevent leakage of the gel. The neck ring 82 may fit snuggly on the end of the grip to seal the first end 78 to the first neck 70, or may be affixed with an additional adhesive or crimping, or otherwise secured to ensure a tight, secure seal.

After the seal is formed at between the first neck 70 and the first end 78, the gel 42 may be injected into the cavity at the opposite end of the grip between the second neck 72 and the second end 80. This step may be performed either before or after the core 66 and sleeve 68 are attached to the head 62 of the hair brush 60. It should also be noted that the second neck 72 in the illustrated embodiment is dimensioned to extend beyond the second end 80 of the sleeve 68 to facilitate engagement with the cap 76. After the neck ring 82 is attached to the first neck 70 and first end 78, the post 64 of the hair brush 60 is inserted into the core 66 through the first neck 70 with the neck ring 82 abutting the head 62 of the hair brush 60. The neck ring 82 may be configured such that the outer surface of the neck ring 82 aligns with the outer surface of the head 62 to form a substantially continuous surface between head 62 and the handle.

To secure the grip assembly to the head 62, the core 66 may be connected to the post 64 by an internal screw 86, which is visible in FIG. 8 through the cut-away portion of the core 66. The core 66 includes an internal wall 88 having an opening 90 through which the screw 86 is inserted. The post 64 includes a corresponding opening 92 configured to receive and securely retain the screw 86. When the post 64 is inserted through the first neck 70, the end opposite the head 62 is disposed proximate the wall 88 so that the opening 92 is positioned to receive the screw 86 to secure the grip assembly to the post 64. After the grip assembly is connected to the post 64, the gel is injected into the cavity defined by the core 66 and the sleeve 68, and the second neck 72 and second end 80 are sealed by attachment of the second neck ring 84 and/or other sealing mechanism, the cap 76 may be attached to the second neck 72 to close the end of the grip assembly and handle. As previously discussed, the second neck 72 in the illustrated embodiment includes annular ribs 74. The cap 76 may include corresponding internal annular grooves (not shown) configured to receive and engage the ribs 74 of the second neck 72 to secure the cap 76 to the end of the grip assembly. Alternatively, the cap 76 may be secured to the second neck 72 using any other appropriate connection mechanism.

Figure 9:
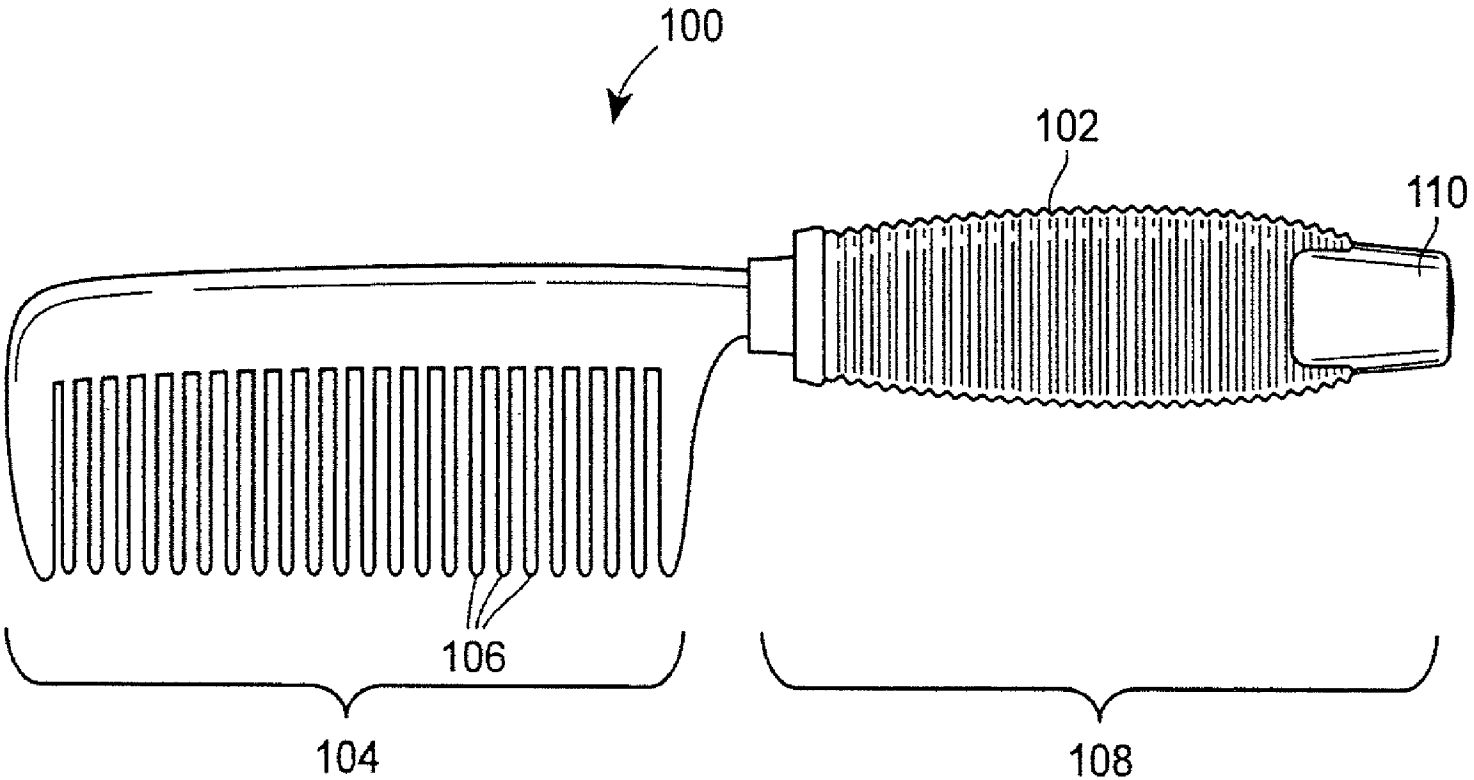
FIG. 9 is a side view of an embodiment of a comb having a ribbed gel-filled grip disposed on the handle.

The gel filled ribbed sleeve 36 is not limited for use with the hair brush 20, but may be utilized with other devices, for example, writing utensils, containers, cosmetic applicators, grips, and other devices. FIG. 9 illustrates an example of a comb 100 incorporating a ribbed gel grip 102 in accordance with the present disclosure. The comb 100 includes a body 104 including the teeth 106 of the comb 100, and an outwardly extending handle 108 having the grip 102 disposed thereon. The grip 102 may be secured to a post of the handle 108 by a cap 110 disposed on the end of the handle 108 opposite the body 104 of the comb 100, or may have a core of the grip 102 attached to the post of the handle 108 is a similar manner as the core 66 is attached to the post 64. The grip 102, handle 108 and cap 110 may be configured similar to the corresponding elements of the brushes 20 and/or 60 as described above, or may be configured in any other manner to provide an enclosed cavity for the gel of the grip 102 and attachment of the grip 102 to the handle 108, such as through the alternative embodiments discussed above.

Figure 11:
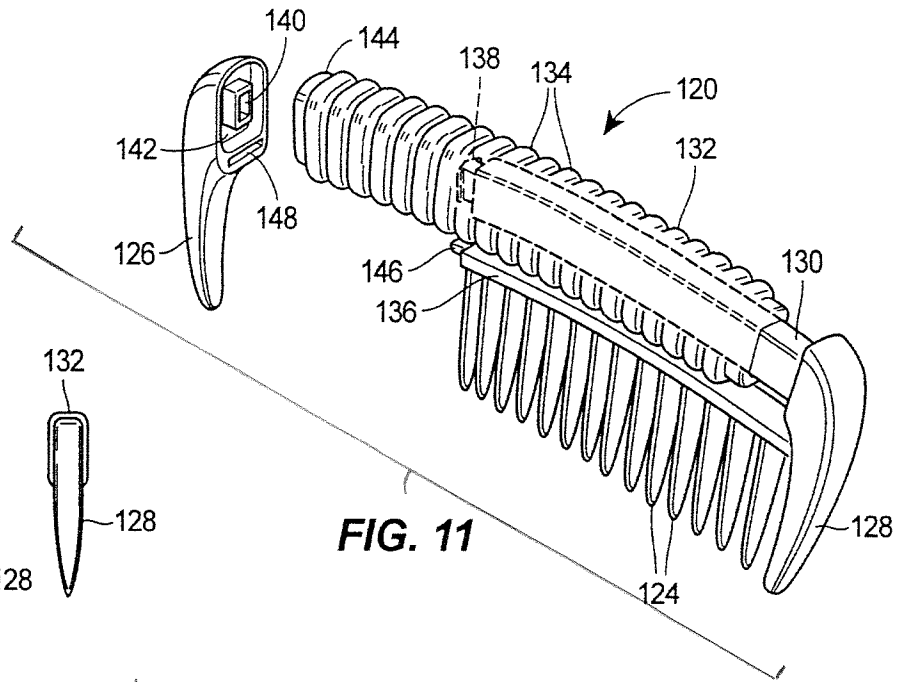
FIG. 11 is a partially exploded perspective view of the comb of FIG. 10.
Figure 10:
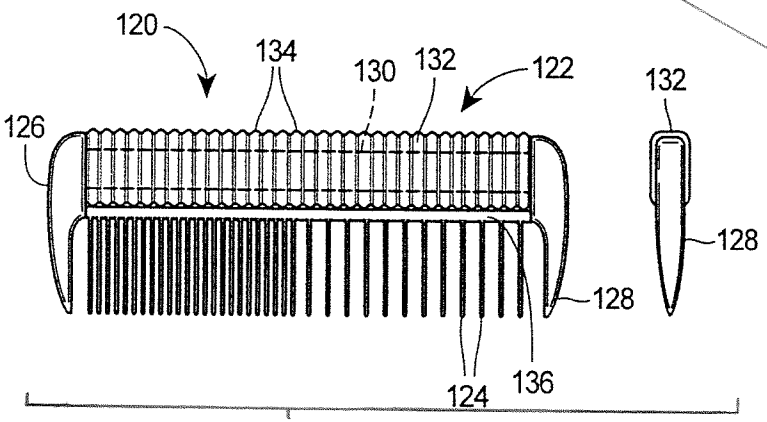
FIG. 10 is a side and an end view of an alternative embodiment of a pocket comb having a ribbed gel-filled grip disposed on the spine of the comb.
Figure 12:
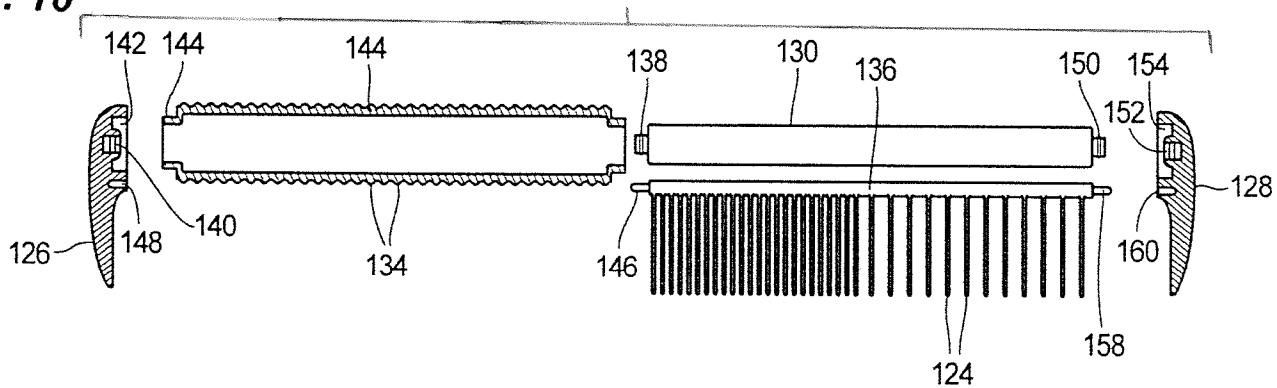
FIG. 12 is a side exploded view of the components of the comb of FIG. 10.

As a further alternative, FIGS. 10-12 illustrate the incorporation of the ribbed gel grip into the handle portion of a pocket comb. Referring to FIG. 10, the comb 120 is generally configure as a pocket comb, and includes a spine portion 122 supporting a plurality of outwardly extending teeth or bristles 124, and oppositely disposed bristle guards 126, 128 on either end of the comb 120 extending downwardly parallel to the bristles 124. The spine portion 122 of the comb 120 includes multiple components to accommodate the ribbed gel grip. In the illustrated embodiment, the spine portion 122 includes an inner core or handle 130 surrounded by a flexible sleeve 132 having a plurality of undulations or ridges 134 on the outer surface. The outer surface of the core 130 and the inner surface of the sleeve 132 define a cavity for receiving and storing the gel of the ribbed gel grip. The spine portion 122 further includes a separate bristle support 136 connected between the bristle guards 126, 128 and from which the bristles 124 extend. In one embodiment, the bristle support 136 may be flexible such that the bristle support 136 deflects toward the core 130, and compresses the ribbed gel grip if necessary, when the tips of the bristles 124 engage a user's scalp in a similar manner as described for the combs in co-pending U.S. patent application Ser. No. 11/339,210, filed on Jan. 25, 2006 and entitled "Ouchless Comb," now abandoned the specification of which is expressly incorporated by reference herein.

The partially and fully exploded views of FIGS. 11 and 12, respectively, illustrate the various components of the pocket comb 120 in greater detail. Referring to FIG. 11, the comb 120 is shown with the bristle guard 126 detached from the comb 120 and the sleeve 132 partially removed from the core 130. The bristle guard 126 is configured to retentively engage the core 130 and bristle support 136 when the comb 120 is assembled. The core 130 includes an outwardly extending male snap member 138 that is received into and retained by a corresponding female snap member 140 of the bristle guard 126. The female snap member 140 is surrounded by a channel 142 configured to receive an end 144 of the sleeve 132 having a reduced outer diameter so that the end 144 of the sleeve 132 fits snuggly within the channel 142. If desired, the channel 142 may be dimensioned to engage the end 144 of the sleeve 132 and press the end into engagement with the outer surface of the core 130 to seal the cavity. The bristle support 136 includes an outwardly extending finger 146 that is received into a corresponding groove 148 of the bristle guard 126 and retained when the bristle support 136 is connected to the core 130 by the male and female snap members 138, 140 to support the bristles 124 in position.

FIG. 12 shows the fully disassembled comb 120. As will be apparent from FIG. 12, the bristle guard 128 and corresponding ends of the core 130 and bristle support 136 may be configured in a similar manner as the bristle guard 126 and ends discussed above. Consequently, an outwardly extending male snap member 150 of the core 130 is received and retained by a corresponding female snap member 152 of the bristle guard 128, with a channel 154 of the bristle guard 128 receiving a second end 156 of the sleeve 132. At the same time, an outwardly extending finger 158 of the bristle support 136 is received into a corresponding groove 160 of the bristle guard 128.

Due to the symmetrical configuration, the comb 120 may be assembled starting at either end. For example, the sleeve 132 may be slid onto the core 130, and the male snap member 150 may be inserted into the female snap member 152 of the bristle guard 128 with the end 156 of the sleeve 132 being received into the channel 154. Depending on the particular configuration, engagement by the channel 154 may seal the end 156 of the sleeve 132, or the end 156 may be sealed by any other mechanism such as those discussed above before the core 130 is attached to the bristle guard 128. With the core 130 attached to the bristle guard 128, the finger 158 of the bristle support 136 is inserted into the groove 160 of the bristle guard 128. Prior to attaching the opposite bristle guard 126, the gel may be injected between the end 144 of the sleeve 132 and the core 130 and into the cavity, and the end 144 may then be sealed to the core 130. The assembly process is completed by aligning the male snap portion 138 and finger 146 with the female snap portion 140 and groove 148, and connecting the core 130 to the bristle guard 126 with the end 144 of the sleeve 132 disposed within the channel 142.

Figure 13:
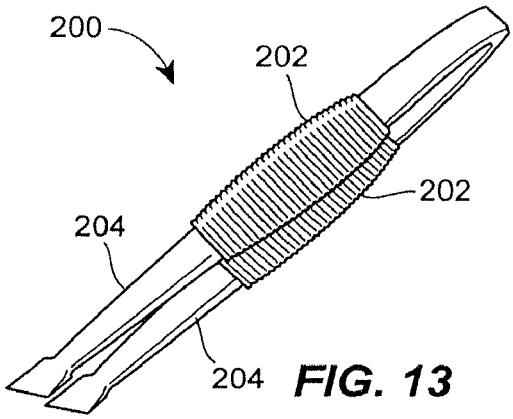
FIG. 13 is a perspective view of an embodiment of a pair of tweezers having ribbed gel-filled grips disposed on the arms.

FIG. 13 illustrates another implementation of the ribbed gel grip in a standard pair of tweezers 200. The tweezers 200 include ribbed gel grips 202 disposed on either post or arm 204 of the tweezers 200. In this embodiment, the core 46 of each grip 202 may be configured to correspond to the cross-section of the arms 204 of the tweezers 200, and is either shaped to conform to the arms 204, or fabricated from a flexible or resilient material that allows the core 46 and the sleeve 36 of the grip 202 to conform to the shape of the arms 204. As illustrated, the ends of the sleeve 36 may be sealed to the core 46, such as by one of the sealing mechanisms discussed above, the core 46 slides onto the corresponding arm 204, and the core 46 and/or the ends of the sleeve 36 are secured to the surface of the arm 204 by an adhesive, a snug fit between the core 46 and the arm 204 or by any other connection mechanism.

Figure 14:
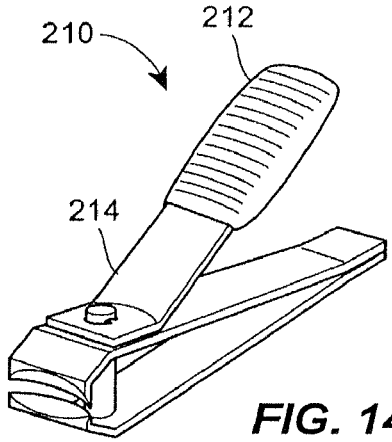
FIG. 14 is a perspective view of an embodiment of nail clippers having a ribbed gel-filled grip disposed on the handle.
Figure 15:
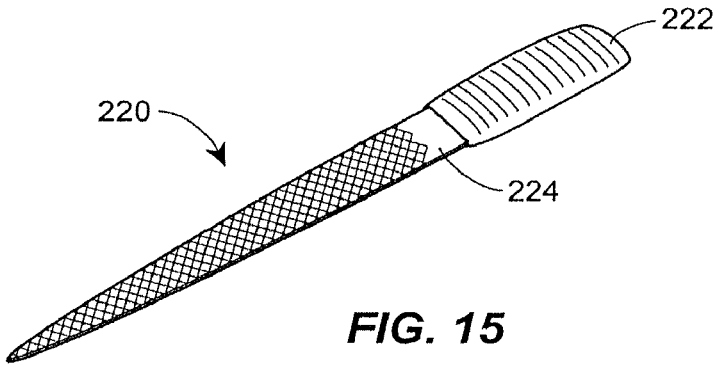
FIG. 15 is a perspective view of an embodiment of a nail file having a ribbed gel-filled grip disposed on the handle.

FIGS. 14 and 15 illustrate similar implementations of the ribbed gel grip on a standard pair of nail clippers 210 and a nail file 220, respectively. In these embodiments, the core 46 and sleeve 36 of the grips 212, 222 are shaped to conform to the ends of the post forming the lever arm 214 and handle 224, respectively, and include an open end and a closed end. The closed end of the core 46 may be slid into the open end of the sleeve 36, after which the gel 42 may be injected into the cavity 48. After the open ends of the core 46 and sleeve 36 are sealed to retain the gel 42 in the cavity 48, the grips 212, 222 may be slid over the lever arm 214 and handle 224, respectively, until the tips of the lever arm 214 and handle 214 abut the closed ends of the grips 212, 222. Once in place, the grips 212, 222 are secured to the outer surfaces of the lever arm 214 and handle 224.

Figure 16:
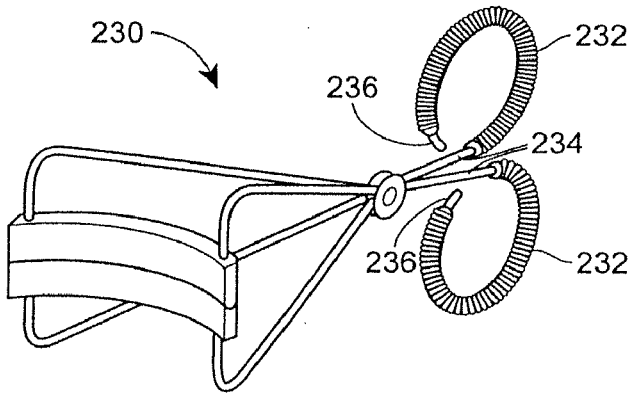
FIG. 16 is a perspective view of an embodiment of an eyelash curler having ribbed gel-filled grips disposed on the handles.

In the implementation illustrated in FIG. 16, ribbed gel grips 232 are disposed on the posts or handles 234 of an eyelash curler 230. In order to accommodate the circular or semi-circular handles 234 of the eyelash curler 230, the core 46 of the grips 232 may either be curved to conform to the shapes of the handles 234, or be fabricated from a flexible material so that the grips 232 may be deformed to match the shapes of the handles 234 during assembly. After the grips 232 are assembled, such as in a manner as described above, the grips 232 may be slid over the tips 236 at the open ends of the handles 234 of the eyelash curler 230 and into position as shown in FIG. 16.

Figure 17:
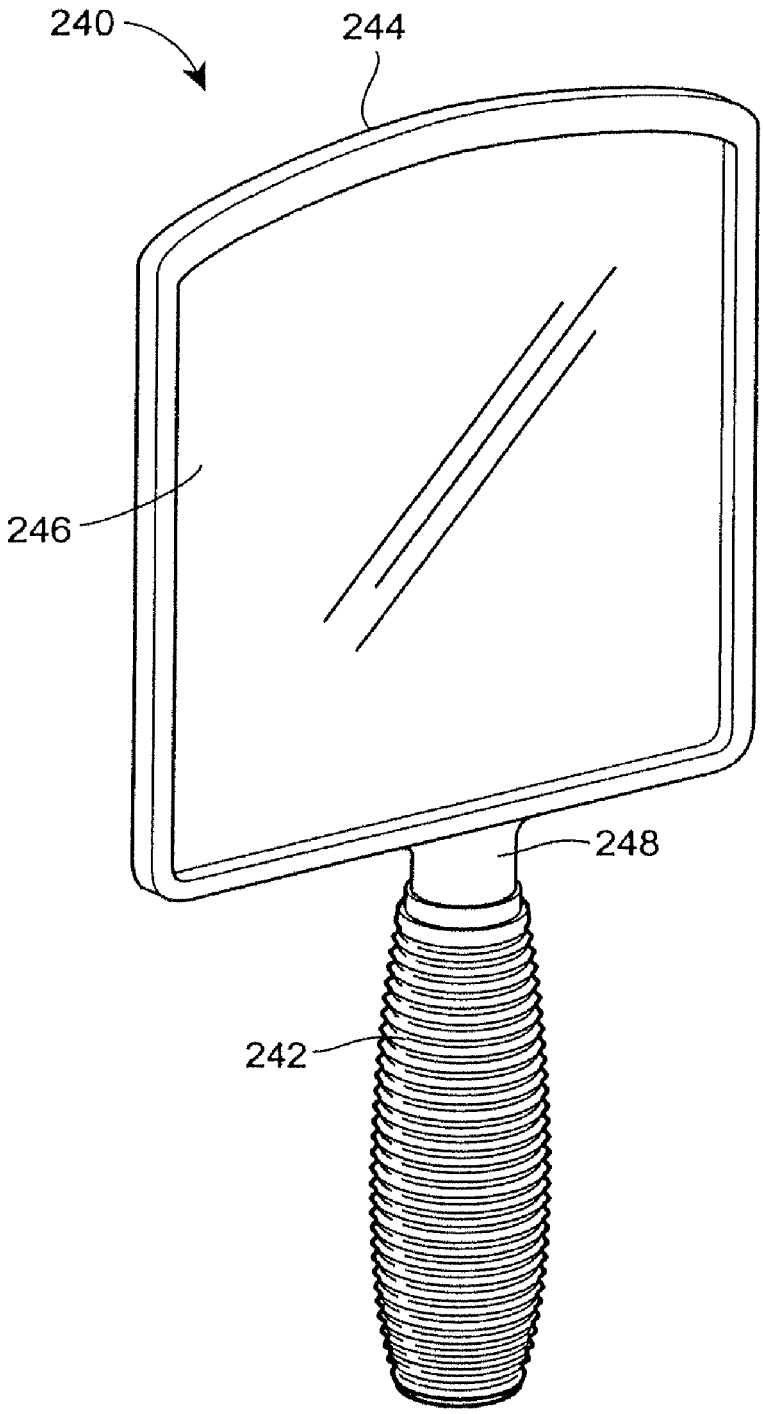
FIG. 17 is a perspective view of an embodiment of a hand mirror having a ribbed gel-filled grip disposed on the handle.

FIG. 17 illustrates an example of a hand mirror 240 incorporating a ribbed gel grip 242 in accordance with the present disclosure. The hand mirror 240 includes a body 244 including the mirror 246, and an outwardly extending handle 248 having the grip 242 disposed thereon. In the illustrated embodiment, the grip 242 may be configured in a similar manner as described above for the grips 212, 222 of the nail clippers 210 and nail file 220, and have an open end that slides the post of over the handle 248 until the end of the post engages a closed end of the grip 242. Alternatively, the grip 242 may be configured similar to the grips of the hair brush 20 and comb 100 with two open ends, and with the hand mirror 240 further including a cap attached to the end of the post of the handle 248 to secure the grip 242 thereto.

Figure 18:
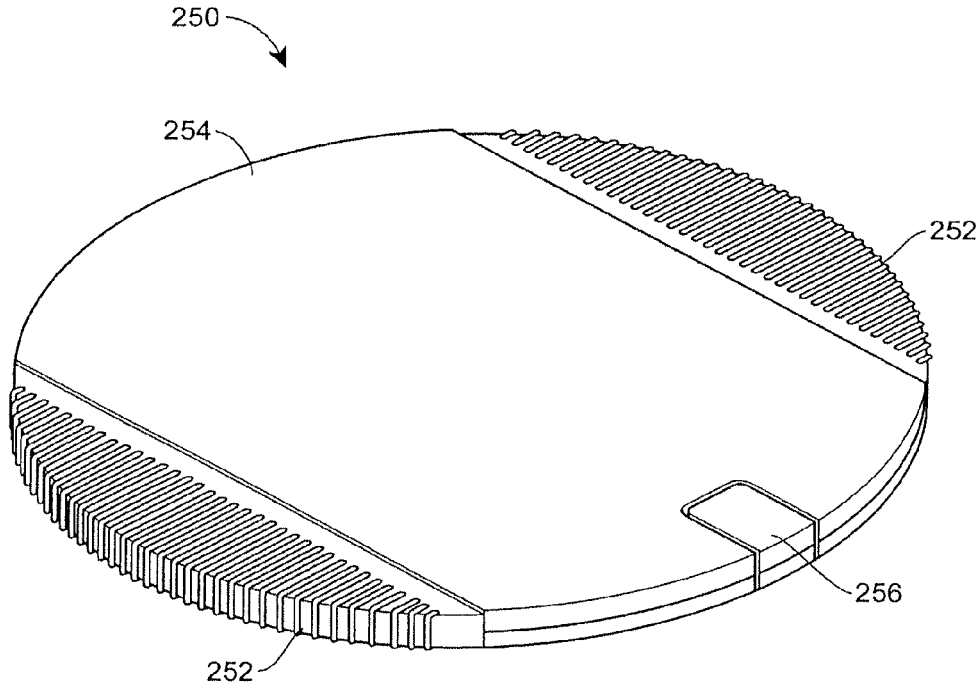
FIG. 18 is a perspective view of an embodiment of a circular mirror having ribbed gel-filled grips disposed on opposite edges thereof.

In a still further embodiment shown in FIG. 18, a circular mirror 250 may include a pair of ribbed gel grips disposed along its edge on opposite sides of the mirror 250. In the illustrated embodiment, the circular mirror 250 may include a cover 254 that may be opened by releasing a latch 256 to expose a mirror disposed therein. The sleeves 36 and cores 46 of the grips 252 may be shaped to conform to the outer edges of the mirror 250 so that the grips 252 may be slid onto the outer edges after the core 46 is received into the sleeve 36, the gel 42 is injected in the cavity 48 between the sleeve 36 and the core 46, and the open ends of the sleeve 36 and core 46 are sealed together to retain the gel 42. Alternatively, in lieu of injected the gel 42 after the core 46 is nested within the sleeve 36, a sufficient amount of the gel 42 may be deposited in the sleeve 36 before the core 46 is inserted so that the gel 42 is displaced around the core 46 when the core 46 is inserted into sleeve 36 to fill the cavity 48.

In addition to the embodiments illustrated and described herein, those skilled in the art will understand that ribbed gel grips as described therein may be incorporated into other personal care items typically used be consumers and personal care professionals. For example, ribbed gel grips may be incorporated into the handles of electric personal care items, such as flat irons, curling irons, blow dryers and the like. Further, other graspable items, including those with and without handles, may have ribbed gel grips incorporated therein to improve the comfort and tactile feel of the item while in use. Consequently, the ribbed gel grip may be incorporated into hand tools such as, for example, screwdrivers, chisels, pliers, vice grips, corded and cordless drills. Other implementations of the ribbed gel grips in graspable items will be apparent to those skilled in the art and are contemplated by the inventors.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A hair brush comprising:

a body having a plurality of outwardly extending bristles;

a post connected to and extending outwardly away from the body; and a grip disposed on the post, the grip comprising:

a hollow core configured to slide onto the post, a hollow sleeve configured to slide onto the exterior of the core such that the core and the sleeve define a cavity therebetween, and a quantity of a gel disposed within the cavity, wherein the ends of the sleeve are sealed against the corresponding ends of the core to retain the gel within the cavity, and wherein the gel allows the sleeve to deform to conform to the shape of a user's hand when the grip is grasped by the user, wherein the post extends less than the entire length of the grip, the core includes an internal wall, and the grip further comprises a fastener that couples the core internal wall to the post.

2. A hair brush in accordance with claim 1, comprising a cap connected to the end of the post opposite the body and engaging the grip to retain the grip on the post and to prevent substantial axial movement of the core along the post.

3. A hair brush in accordance with claim 1, wherein the grip comprises a neck ring disposed on the end of the grip proximate the body and engaging the corresponding ends of the sleeve and core to seal the end of the grip.

4. A hair brush in accordance with claim 3, wherein the grip comprises a second neck ring disposed on the end of the grip opposite the body and engaging the corresponding ends of the sleeve and core to seal the end of the grip.

5. A hair brush in accordance with claim 1, wherein the body comprises a neck extending away from the body and encircling the post, wherein the neck receives the end of the grip proximate the body to prevent further substantial axial movement of the core in the direction of the body.

6. A hair brush in accordance with claim 1, wherein the core and the sleeve each have an open end and a closed end, and wherein the core is received in the sleeve with the closed end inserted first and the open end of the core is disposed proximate the open end of the sleeve when the core is disposed therein.

7. A hair brush in accordance with claim 6, wherein the end of the post opposite the body abuts the closed end of the core when the grip is disposed on the post.

8. A hair brush in accordance with claim 1, wherein the post defines an opening, the core internal wall defines an opening, and the fastener comprises at least one screw that is received through the post opening and the core internal wall opening.

9. A hair brush in accordance with claim 1, wherein the post includes an endwall in which the opening is defined, and the post endwall and the core internal wall are each generally perpendicular to the longitudinal axis of the grip.

10. A personal care item comprising:

a body;

a post connected to and extending outwardly away from the body; and a grip disposed on the post, the grip comprising:

a hollow core configured to slide onto the post, a hollow sleeve configured to slide onto the exterior of the core such that the core and the sleeve define a cavity therebetween, and a quantity of a gel disposed within the cavity, wherein the ends of the sleeve are sealed against the corresponding ends of the core to retain the gel within the cavity, and wherein the gel allows the sleeve to deform to conform to the shape of a user's hand when the grip of the personal care item is grasped by the user, wherein the post extends less than the entire length of the grip, the core includes an internal wall, and the grip further comprises a fastener that couples the core internal wall to the post.

11. A personal care item in accordance with claim 10, comprising a cap connected to the end of the post opposite the body and engaging the grip to retain the grip on the post and to prevent substantial axial movement of the core along the post.

12. A personal care item in accordance with claim 10, wherein the grip comprises a neck ring disposed on the end of the grip proximate the body and engaging the corresponding ends of the sleeve and core to seal the end of the grip.

13. A personal care item in accordance with claim 12, wherein the grip comprises a second neck ring disposed on the end of the grip opposite the body and engaging the corresponding ends of the sleeve and core to seal the end of the grip.

14. A personal care item in accordance with claim 10, wherein the body comprises a neck extending away from the body and encircling the post, wherein the neck receives the end of the grip proximate the body to prevent further substantial axial movement of the core in the direction of the body.

15. A personal care item in accordance with claim 10, wherein the core and the sleeve each have an open end and a closed end, and wherein the core is received in the sleeve with the closed end inserted first and the open end of the core is disposed proximate the open end of the sleeve when the core is disposed therein.

16. A personal care item in accordance with claim 15, wherein the end of the post opposite the body abuts the closed end of the core when the grip is disposed on the post.

17. A personal care item in accordance with claim 10, wherein the personal care item comprises one of a hair brush, a comb, a pair of tweezers, a nail clipper, a nail file, an eyelash curler and a mirror.

18. A personal care item in accordance with claim 10, wherein the post defines an opening, the core internal wall defines an opening, and the fastener comprises at least one screw that is received through the post opening and the core internal wall opening.

19. A personal care item in accordance with claim 10, wherein the post includes an endwall in which the opening is defined, and the post endwall and the core internal wall are each generally perpendicular to the longitudinal axis of the grip.

20. A method of assembling the hair brush of claim 1, comprising sliding the sleeve onto the core, sealing first ends of the sleeve and the core together, filling the cavity with the gel, sliding the gel-filled sleeve/core assembly onto the post, coupling the core internal wall to the post by inserting the fastener into the hollow core, and installing an endcap onto second ends of the sleeve and the core.

21. A method of assembling the personal care item of claim 10, comprising sliding the sleeve onto the core, sealing first ends of the sleeve and the core together, filling the cavity with the gel, sliding the gel-filled sleeve/core assembly onto the post, coupling the core internal wall to the post by inserting the fastener into the hollow core, and installing an endcap onto second ends of the sleeve and the core.

* * * * *